US007833079B2

(12) United States Patent
Willinger et al.

(10) Patent No.: US 7,833,079 B2
(45) Date of Patent: Nov. 16, 2010

(54) NOISE PRODUCING TOY STRUCTURE

(75) Inventors: Jonathan Willinger, Tenafly, NJ (US); Ryan Rutherford, Belleville, NJ (US)

(73) Assignee: J.W. Pet Company, Inc., Teterboro, NJ (US)

( * ) Notice: Subject to any disclaimer, the term of this patent is extended or adjusted under 35 U.S.C. 154(b) by 158 days.

(21) Appl. No.: 11/937,631

(22) Filed: Nov. 9, 2007

(65) Prior Publication Data

US 2008/0064292 A1 Mar. 13, 2008

Related U.S. Application Data

(63) Continuation-in-part of application No. 11/312,244, filed on Dec. 20, 2005, and a continuation-in-part of application No. 11/312,071, filed on Dec. 20, 2005, and a continuation of application No. 10/889,962, filed on Jul. 13, 2004, now Pat. No. 7,066,779.

(51) Int. Cl.
*A63H 3/31* (2006.01)
*A01K 29/00* (2006.01)

(52) U.S. Cl. ..... 446/184; 119/707; 446/188

(58) Field of Classification Search ..... 119/707, 119/709, 711; 446/183, 184, 188
See application file for complete search history.

(56) References Cited

U.S. PATENT DOCUMENTS

| | | | |
|---|---|---|---|
| 754,148 | A | 3/1904 | Kuhlemann |
| 1,187,838 | A | 6/1916 | Hughes |
| 1,612,651 | A | 12/1926 | Thomas |
| 1,668,785 | A | 5/1928 | Smart |
| 2,631,407 | A | 3/1953 | Rempel |
| 2,712,201 | A | 7/1955 | Wintriss |
| 2,714,275 | A | 8/1955 | Proll |
| 2,734,309 | A | 2/1956 | Seaver |
| 2,745,214 | A | 5/1956 | Lawson |
| 2,763,960 | A | 9/1956 | Wintriss |
| 2,777,252 | A | 1/1957 | Tancredi et al. |
| 2,817,116 | A | 12/1957 | Miller et al. |
| 2,975,550 | A | 3/1961 | Miller |
| 3,075,317 | A | 1/1963 | Craft |
| 3,702,038 | A | 11/1972 | Hakim |
| 3,956,850 | A | 5/1976 | Seidenberg |
| RE29,050 | E | 11/1976 | Hakim |
| 4,253,254 | A | 3/1981 | Gill |
| 4,380,134 | A | 4/1983 | Taluba et al. |
| 4,506,468 | A | 3/1985 | Willhite |
| 4,779,344 | A | 10/1988 | Panisch |
| 5,113,784 | A | 5/1992 | Forselius |
| 5,267,885 | A | 12/1993 | Niskern et al. |
| 6,112,703 | A | 9/2000 | Handelsman |
| 6,216,640 | B1 | 4/2001 | Zelinger |

(Continued)

OTHER PUBLICATIONS

Bowzer Ball images taken on May 13, 2008, copyright statement on label indicating copyright date of 2006.

*Primary Examiner*—John Ricci
(74) *Attorney, Agent, or Firm*—Katten Muchin Rosenman LLP

(57) ABSTRACT

A noise producing toy structure includes a toy having an outer wall, which defines an inner space. A sealed cavity and a chamber are disposed in the inner space. An opening in the outer wall passes ambient fluid into the chamber and a noise producing element places the cavity in fluid communication with the chamber. Other noise producing toy structures are also disclosed.

15 Claims, 18 Drawing Sheets

U.S. PATENT DOCUMENTS

| | | | |
|---|---|---|---|
| 6,413,139 | B1 | 7/2002 | Douglas |
| 6,609,944 | B1 | 8/2003 | Viola |
| 6,881,120 | B1 | 4/2005 | Janes |
| 6,935,274 | B1 | 8/2005 | Rothschild |
| 7,066,779 | B2 | 6/2006 | Willinger |
| 7,201,117 | B2 | 4/2007 | Ritchey |
| 7,343,878 | B2 | 3/2008 | Ritchey |
| 2001/0008125 | A1 | 7/2001 | Mann |
| 2002/0102912 | A1 | 8/2002 | Duval |
| 2007/0245976 | A1 | 10/2007 | Ritchey |

NOISE PRODUCING TOY STRUCTURE

RELATED APPLICATIONS

The present application is a continuation-in-part of and claims priority to U.S. Ser. No. 11/312,244 filed on Dec. 20, 2005, which is hereby incorporated in its entirety for all purposes, and which is Pending and claims the benefit of U.S. Ser. No. 10/889,962.

The present application is a continuation-in-part of and claims priority to U.S. Ser. No. 11/312,071 filed on Dec. 20, 2005, which is hereby incorporated in its entirety for all purposes, which is Pending claims the benefit of Ser. No. 10/889,962.

U.S. Ser. No. 10/889,962, filed on Jul. 13, 2004, is now U.S. Pat. No. 7,066,779, which is hereby incorporated in its entirety for all purposes.

BACKGROUND OF THE INVENTION

1. Field of Invention

The present invention relates generally to the field of toys. More specifically, the present invention is related to a noise producing toy structure wherein fluid movement causes a noise.

2. Discussion of Prior Art

Generally, inserting a noise producing element into a Figure or ball toy is well known. U.S. Pat. Nos. 754,148, 1,187,838, 1,668,785, RE29050, 3,075,317 and 3,702,038 show such devices. These patents are hereby incorporated by reference in their entirety.

As far as mounting arrangements go, in the case of vinyl material, as shown in FIG. 1*a* and FIG. 1*b*, the mounting of the squeaker mechanism into a toy is commonly done by molding an opening into the material. A common fitting is inserted into this opening. When bonded this fitting creates a slight whistling sound which could stand alone as a noise element. A barbed squeaker can then be forced into the fitting for a true squeak sound. And for latex material, as shown in FIG. 1*c*, a ribbed mound of material is created with a rough through-hole into which a barbed squeaker is inserted.

The prior art fails to provide squeakers utilizing a separate holder for gluing to a rubber toy. Also, none of the prior art squeakers have the present invention method for complying with child safety standards.

Whatever the precise merits, features, and advantages of the above cited references, none of them achieves or fulfills the purposes of the present invention.

SUMMARY OF THE INVENTION

The present invention includes a mounting arrangement for a squeaker into a rubber ball toy. The squeaker mechanism is trapped within a polystyrene or rubber sleeve to form a noise producing element. The sleeve has a recessed area that tightly mates with an opening in the rubber toy and also includes a bonding surface to secure the sleeve to the toy.

In an alternative embodiment, the sleeve also has fin members that extend orthogonally from a distal end of the sleeve. The total width of the sleeve and the associated fin members is such that it complies with consumer product safety requirements. The fin members make the sleeve substantially larger than the opening in the toy such that it is inherent in the structure that the sleeve and squeaker will fall into the toy if the bond holding the sleeve to the toy happens to fail.

In yet another alternative embodiment, a shroud for enclosing a squeaker has a generally cylindrical but tapered shape and includes two flanges (e.g., an interior flange and an exterior flange) at a proximate end of the shroud. A bonding surface between the two flanges is adapted to fit into an opening in a hollow toy. The interior flange has a diameter that is larger than both the exterior flange and the diameter of the opening in the toy. The structure is thus adapted to retain the shroud enclosing the squeaker within the hollow toy even if the shroud becomes loose from the opening in the toy.

A noise producing toy structure includes a toy having an outer wall, which defines an inner space. A sealed cavity and a chamber are disposed in the inner space. An opening in the outer wall passes ambient fluid into the chamber and a noise producing element places the cavity in fluid communication with the chamber. Other noise producing toy structures are also disclosed.

DESCRIPTION OF THE PREFERRED EMBODIMENTS

Figure 1A:
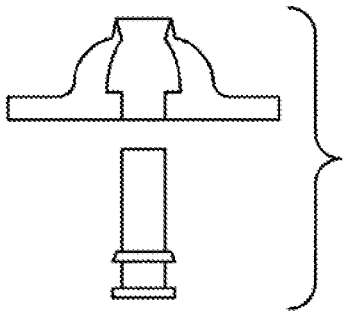
FIG. 1A PRIOR ART
FIG. 1*a* illustrates a prior art common fitting inserted into an opening molded into the vinyl.
Figure 1B:
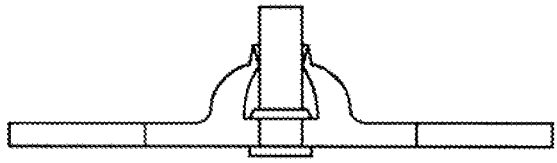
FIG. 1B PRIOR ART
FIG. 1*b* illustrates a prior art method of inserting squeaker into a common fitting.
Figure 1C:
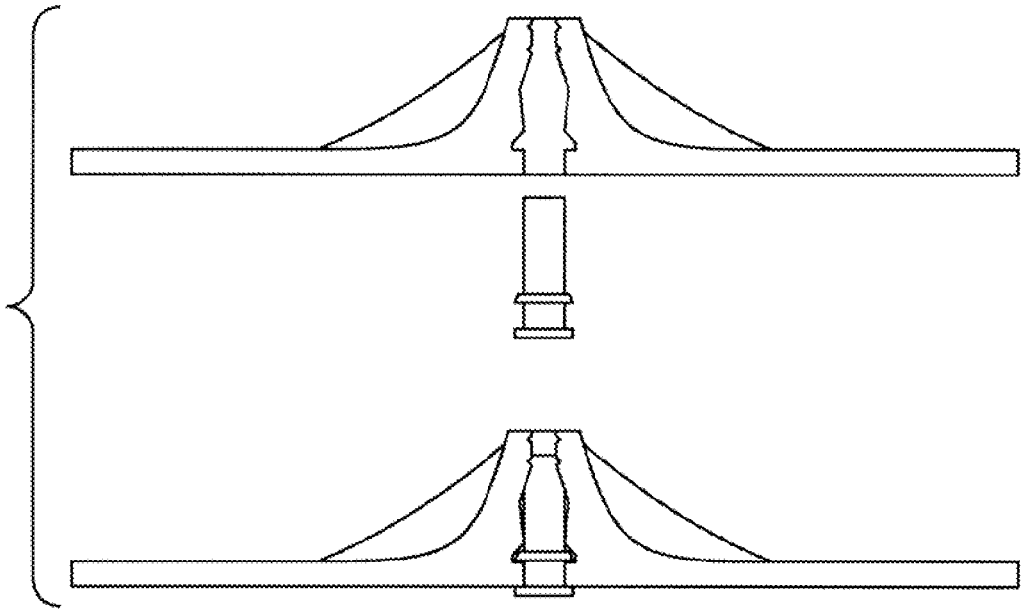
FIG. 1C PRIOR ART
FIG. 1*c* illustrates a prior art method of inserting squeaker into a rough through-hole.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Figure 2A:
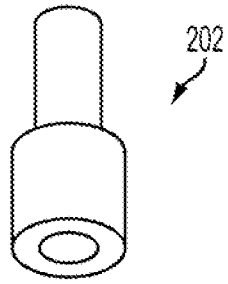
FIG. 2*a* illustrates a typical squeaker mechanism.
Figure 2B:
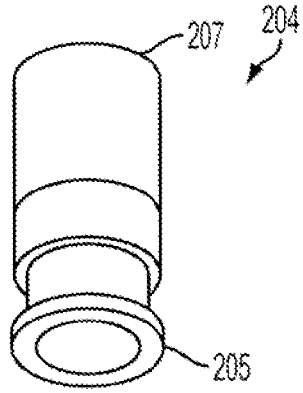
FIG. 2*b* illustrates a rubber sleeve to hold squeaker mechanism.
Figure 2C:
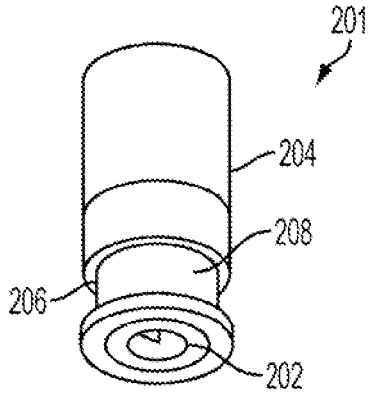
FIG. 2*c* illustrates squeaker mechanism retained in a sleeve and the rubber sleeve including a gluing surface.

FIG. 2*a* shows a typical squeaker mechanism 202. According to a preferred embodiment, FIG. 2*b* shows rubber sleeve 204 with proximate and distal ends 205, 207 respectively. Noise producing element 201 as shown in FIG. 2*c*, is formed by engaging squeaker 202 with sleeve 204 such that squeaker 202 is retained within sleeve 204. The squeaker made from oliphanic material such as polypropylene or polyethylene, is placed into a sleeve that is styrenic and therefore provides a better bonding surface than the squeaker by itself.

Figure 3:
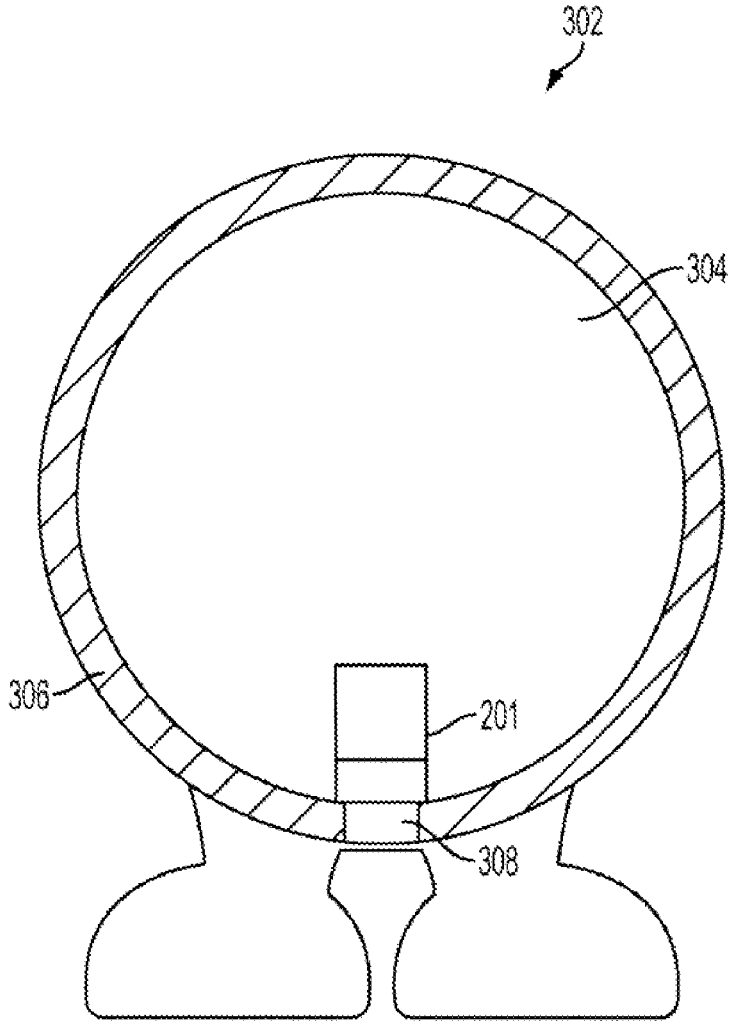
FIG. 3 illustrates mounting arrangement of squeaker in rubber ball.

Referring now to FIG. 3, rubber toy 302 is fashioned of thick-walled heavy-duty rubber. The toy is formed with a hollow body 304 and an outer shell 306. The outer shell is, for example, 2" in diameter. The toy comprises an opening 308 through which the squeaker trapped in a rubber sleeve is inserted. Going back to FIG. 2*c*, the rubber sleeve is utilized as a separate holder for the squeaker and is provided with a bonding surface 208 that aids in the securing of the sleeve to the toy. The sleeve has recessed area 206 that tightly mates with opening 308 in the rubber toy and is bonded to the toy with cyanoacrylate. Please note that functionally equivalent squeaker materials, sleeve materials and bonding agents may be used without departing from the scope of the present invention.

Figure 4A:
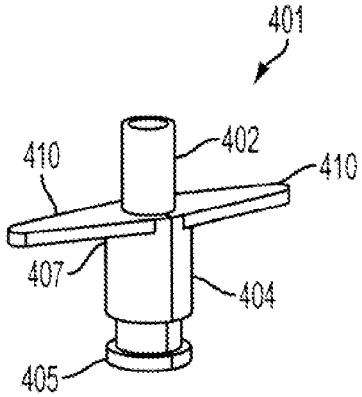
FIG. 4*a* illustrates a squeaker mechanism retained in a polystyrene sleeve.
Figure 4B:
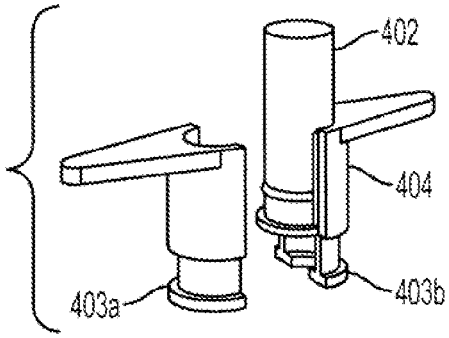
FIG. 4*b* illustrates a sleeve composed of two half shells and extending fins.
Figure 4C:
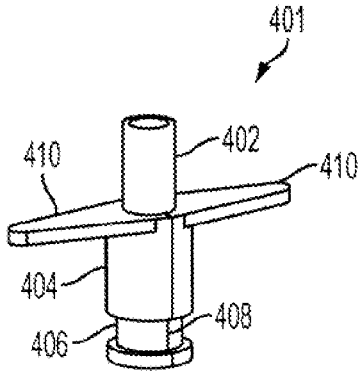
FIG. 4*c* illustrates a sleeve including a gluing surface.

FIGS. 4*a*, 4*b*, 4*c* illustrate a second embodiment of the present invention. FIG. 4*a* shows squeaker 402 retained in polystyrene sleeve 404, with proximate and distal ends 405, 407 respectively, forming noise producing element 401. Sleeve 404 as shown in FIG. 4*b* is composed of two half shells 403*a*, 403*b* to be secured together.

In order to pass the Consumer Product Safety Commission standard for small children, the sleeve size of the present invention must not fall into a 1¼ inch aperture. Therefore to meet the safety ratings, preferably by a ½" diameter, sleeve 404 also includes integral extended members or fins 410 which are orthogonal to squeaker 402 to expand the total width of the sleeve. Please note that fins 410, in an alternative embodiment, may follow the curvature of the inner surface of the small toy.

Figure 5:
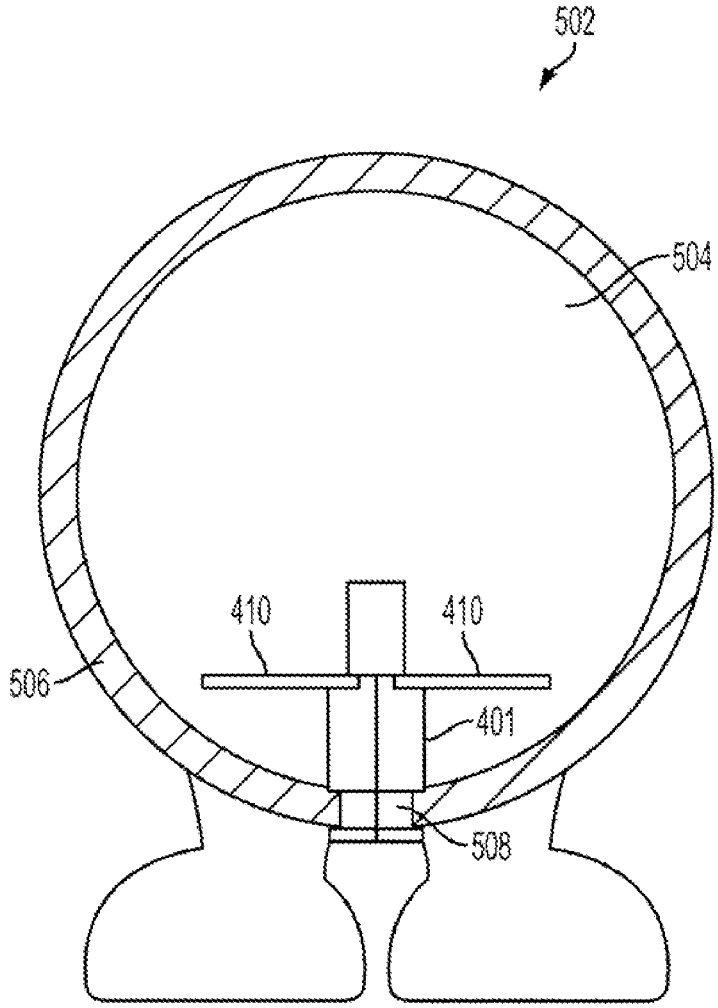
FIG. 5 illustrates mounting arrangement of squeaker in a rubber ball.

Referring to FIG. 5, rubber toy 502 is similar in structure to rubber toy 302 of FIG. 3. The toy is formed with a hollow body 504 and outer shell 506. The outer shell is, for example, 3" in diameter. Sleeve 404 acts as a better bonding surface than squeaker 402. As shown in FIG. 4*c*, recessed area 406 integral to the sleeve mates with an opening 508 in the rubber toy 302. Sleeve 404 including bonding surface 408 secures the sleeve to the rubber toy with cyanoacrylate. Please note that a bigger sized squeaker (with sleeve) could be mounted into a correspondingly bigger toy in a similar manner so as to still provide for the requirements of consumer product safety rating as described above.

As shown in FIG. 5, note that the total width of the sleeve 404 (including the fins 410) is substantially larger than the opening 508 in the rubber toy 302. Thus, it is inherent in the above described structure that even if the cyanoacrylate (or other bonding agent) holding the sleeve 404 to the rubber toy 302 should happen to fail, the sleeve 404 and the squeaker 402 would be retained within the rubber toy 302. That is to say, the sleeve structure that includes the integral fins 410 disclosed in FIG. 5 is inherently adapted to cause the sleeve 404 and the squeaker 402 to fall into the rubber toy 302 (as opposed to falling out of the rubber toy 302) if the bond between the bonding surface 408 of the sleeve 404 separates from the opening 508 in the rubber toy 302.

Figure 6A:
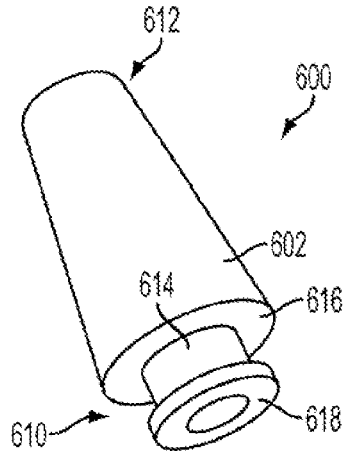
FIG. 6*a* illustrates an isometric view of an additional embodiment of a shroud for protecting a squeaker mechanism.
Figure 6B:
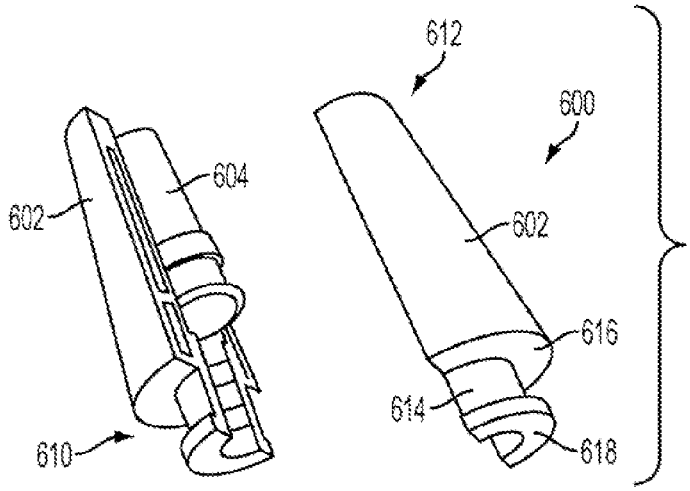
FIG. 6*b* illustrates an open isometric view of the shroud containing a squeaker mechanism of FIG. 6*a;*
Figure 6C:
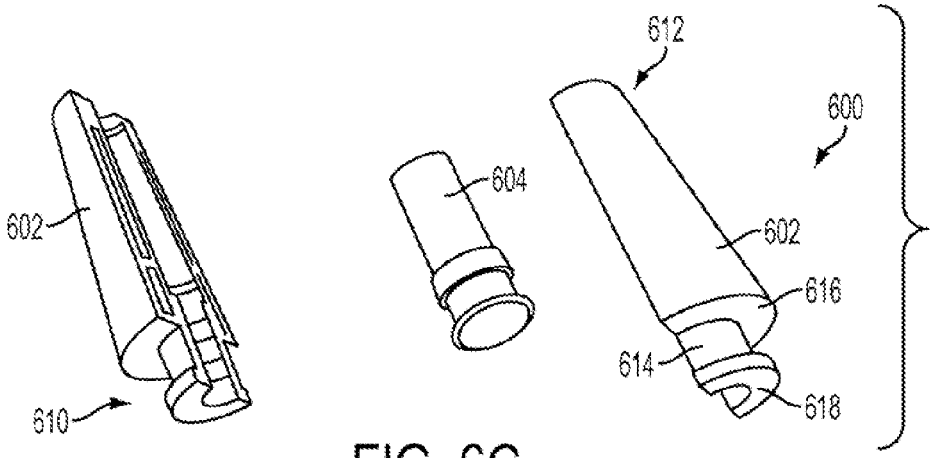
FIG. 6*c* illustrates an exploded isometric view of the shroud containing a squeaker mechanism of FIG. 6*a;*
Figure 6D:
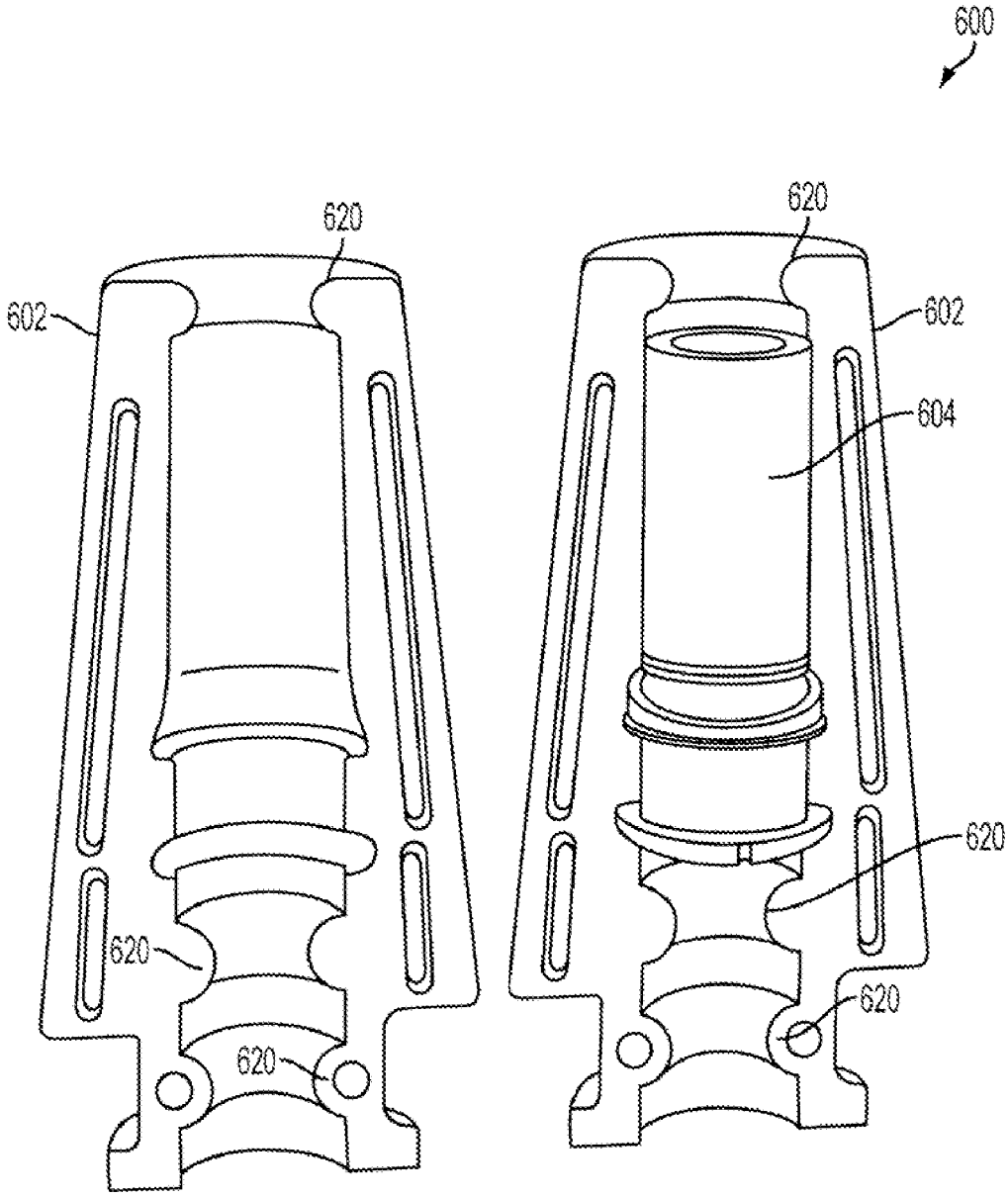
FIG. 6*d* illustrates a close-up open isometric view of the shroud containing a squeaker mechanism of FIG. 6*a;*
Figure 7A:
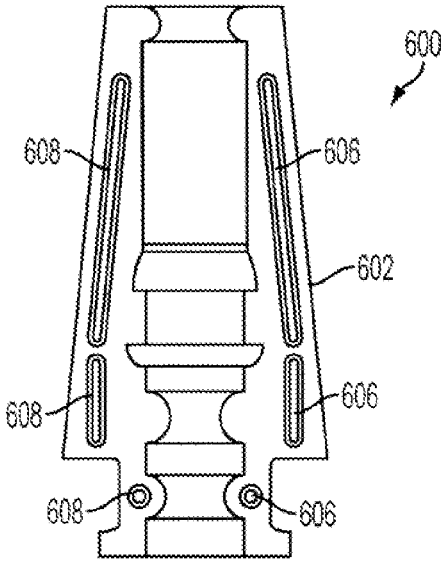
FIG. 7*a* illustrates a front plan view of one half of the sleeve of FIG. 6*a;*
Figure 7B:
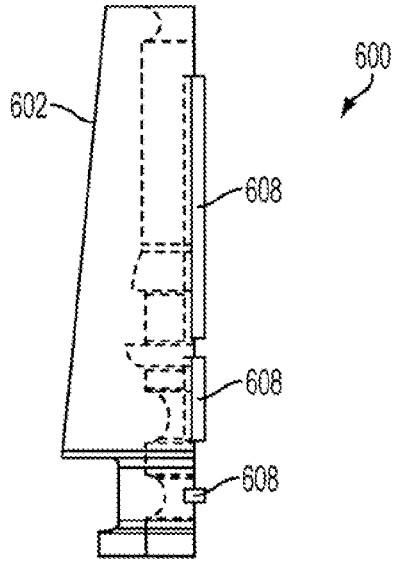
FIG. 7*b* illustrates a side plan view of one half of the sleeve of FIG. 6*a*.
Figure 7C:
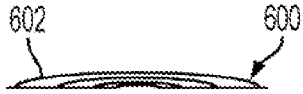
FIG. 7*c* illustrates a top plan view of one half of the sleeve of FIG. 6*a*.

Turning now to FIGS. 6*a* through 6*d* and FIGS. 7*a* through 7*c*, an additional embodiment of the present invention is illustrated. FIG. 6*a* depicts an isometric view of a novel shroud for containing and protecting a squeaker mechanism for use in, e.g., a hollow toy such as a rubber ball or other play device. FIGS. 6*b* through 6*c* depict open, exploded, and close-up open isometric views, respectively, of the shroud containing the squeaker mechanism. FIGS. 7*a* through 7*c* depict front, side, and top plan views of the shroud of FIG. 6*a*.

The embodiment of the present invention that may generally referred to as a noise producing assembly 600 is depicted in FIGS. 6*a*-6*d* and 7*a*-7*c* and may be particularly well adapted to prevent an animal (e.g., a large dog with powerful jaws) from damaging the squeaker mechanism or from biting/chewing out the squeaker mechanism. The depicted noise producing assembly 600 includes a shroud 602 that completely encases a squeaker mechanism 604. The shroud 602 and squeaker mechanism 604 may be made from any practicable material including various plastics, styrenic materials, and those materials described above with respect to the sleeves 204, 404 and squeaker mechanisms 202, 402 of other embodiments. The shroud 602 may be assembled from two identical pieces that may be joined together around the squeaker mechanism 604 as illustrated. In some embodiments, the shroud halves may include cavities 606 that are adapted to receive bosses 608 that serve to align the halves and strengthen the joint. These features may be most clearly seen in FIGS. 7*a* through 7*c*. Note that by having bosses 608 on one side of the shroud half and receiving cavities 606 on the other side of the same shroud half, the same part may be used to manufacture both halves of the shroud 602. The two shroud halves may be joined together using any practicable chemical and/or mechanical bonding method such as methyl ethyl ketone (MEK), cyanoacrylate, other bonding agent, locking pins, snap fasteners, clips, etc., to both lock the squeaker mechanism 604 in place and to protect the squeaker mechanism 604.

Referring to FIG. 6*a*, the shroud 602 and squeaker mechanism 604 may be generally cylindrical. In some embodiments, the shape of the shroud 602 may taper from a wider diameter to a narrower diameter as the shroud 602 extends from a proximate end 610 to a distal end 612. The tapered shape may aid in inserting the noise producing assembly 600 into an opening in a toy (not shown). The proximate end 610 may also include a bonding surface 614 that is adapted to be bonded to the inside of the opening in a toy using any practicable chemical and/or mechanical bonding method such as methyl ethyl ketone (MEK), cyanoacrylate, other bonding agent, locking pins, snap fasteners, clips, etc. The diameter of the shroud 602 at the bonding surface 614 may be sized to precisely fit the opening in the toy.

The shroud 602 may also include an interior flange 616 and an exterior flange 618 at the proximate end 610 that together are adapted to hold the noise producing assembly 600 in the opening of the toy, thereby supporting the bonding method. In some embodiments, the toy may include a countersunk opening (not shown) that is adapted to receive the exterior flange 618 so that the exterior flange 618 sits flush with the outer surface of the toy. The interior flange 616 may have a diameter the size of the widest part of the shroud 602 and be substantially larger than both the exterior flange 618 and the opening in the toy. For example, the diameter of the interior flange 616 may be approximately 1.3 to 5 times larger than the opening in the toy. Other dimensions are possible. The diameter of the exterior flange 618 may be larger than the opening in the toy but smaller than the interior flange 616. This structure insures that even if the bonding method fails, the noise producing assembly 600 can only fall into the toy and cannot exit the toy. Further, even if the opening in the toy is distorted and/or enlarged enough to let the flanges slip through, the noise producing assembly 600 will tend to be more likely to fall into the toy than out of the toy due to the relative sizes of the flanges. Thus, the structure provides an inherent safety feature to the present invention that is operative to prevent an animal from working the noise producing assembly 600 out of the toy through chewing, biting, or otherwise distorting the toy. This safety feature can help prevent choking or other injuries to an animal playing with the toy, because even if the noise producing assembly 600 does become loose, it will remain trapped within the toy.

As indicated above, the squeaker mechanism 604 may be completely contained in the shroud 602. Completely encapsulating the squeaker mechanism 604 in the shroud 602 provides additionally safety features to the present invention. The entire length of the squeaker mechanism 604 may be bonded to the shroud 602 to further prevent removal of the squeaker mechanism 604 from the toy. Referring specifically to FIG. 6*d*, the shroud 602 may also include internal rings 620 that both add structural stability to the noise producing assembly 600 and further secure the squeaker mechanism 604 in the shroud 602 by preventing longitudinal movement of the squeaker mechanism 604 relative to the shroud 602. Each of the internal rings 620 include an opening that is smaller in diameter than the diameter of the squeaker mechanism 604 at the ends of the squeaker mechanism 604. The body of the squeaker mechanism 604 may further include annular protrusions and recesses that mate with corresponding recesses and protrusions in the inner surface of the shroud 602 that also prevent longitudinal movement of the squeaker mechanism 604 relative to the shroud 602. The added structural stability of the internal rings 620 insures that the noise producing assembly 600 cannot be crushed by an animal playing with the toy or by chewing, biting, or otherwise distorting the toy.

FIGS. 8*a*-8*g* are cross-sectional schematic views of respective noise producing toy structures in accordance with one or more embodiments of the present invention. Although the figures illustrate a body having a substantially circular outer wall in cross-section, the present invention is not limited to a toy or toy structure that is circular in cross-section. The cross-sectional shapes herein are illustrative only, and, thus, square, octagonal, irregular, rectangular, and/or any other shape that may be suitable are contemplated for use.

The body comprises natural rubber, synthetic rubber, thermoplastic elastomers, vinyl, and/or like elastic and/or resilient material and preferably when thrown provides a bounce to enhance the use of the toy or when used is resiliently elastic to permit the partial or complete evacuation of fluid media from one or more cavities or spaces. As used herein "used" refers to the toy being thrown, squeezed, impacted, manipulated or otherwise temporarily deformed sufficient to permit the partial or complete evacuation of fluid media, such as air, from one or more cavities or spaces.

The cavities described herein need not extend along the entire length of the body but may be formed with end walls and thus comprise structures upright from another wall.

As taught herein, the mounting of a squeaker is different in vinyl or in natural rubber or synthetic rubber. Herein, natural or synthetic rubber is preferred as a body for the toy.

A noise producing toy structure 700*a*-700*g* for a toy for a pet or human comprises a respective toy 702*a*-702*g* and a noise producing assembly or noise producing element 704, hereinafter referred to as a squeaker 704 for simplicity. Squeaker 704 may be any of the squeakers taught previously and especially noise producing assembly 600 having a shroud 602 that completely encases a squeaker mechanism, and which is mounted in the toy.

Respective toy 702*a*-702*g* includes a respective body 706*a*-706*g* comprising one or more sealed cavities 730*a*-730*g* in fluid communication via the squeaker with a dampening cavity or structure 740*a*-740*g*.

The dampening chamber limits the quantity of air movement through the squeaker to prolong the noise produced by the squeaker. The dampening chamber also recesses the squeaker from a user accessible area of the toy reducing the potential of a user, such as a pet or a child, removing and/or ingesting the squeaker.

Figure 8A:
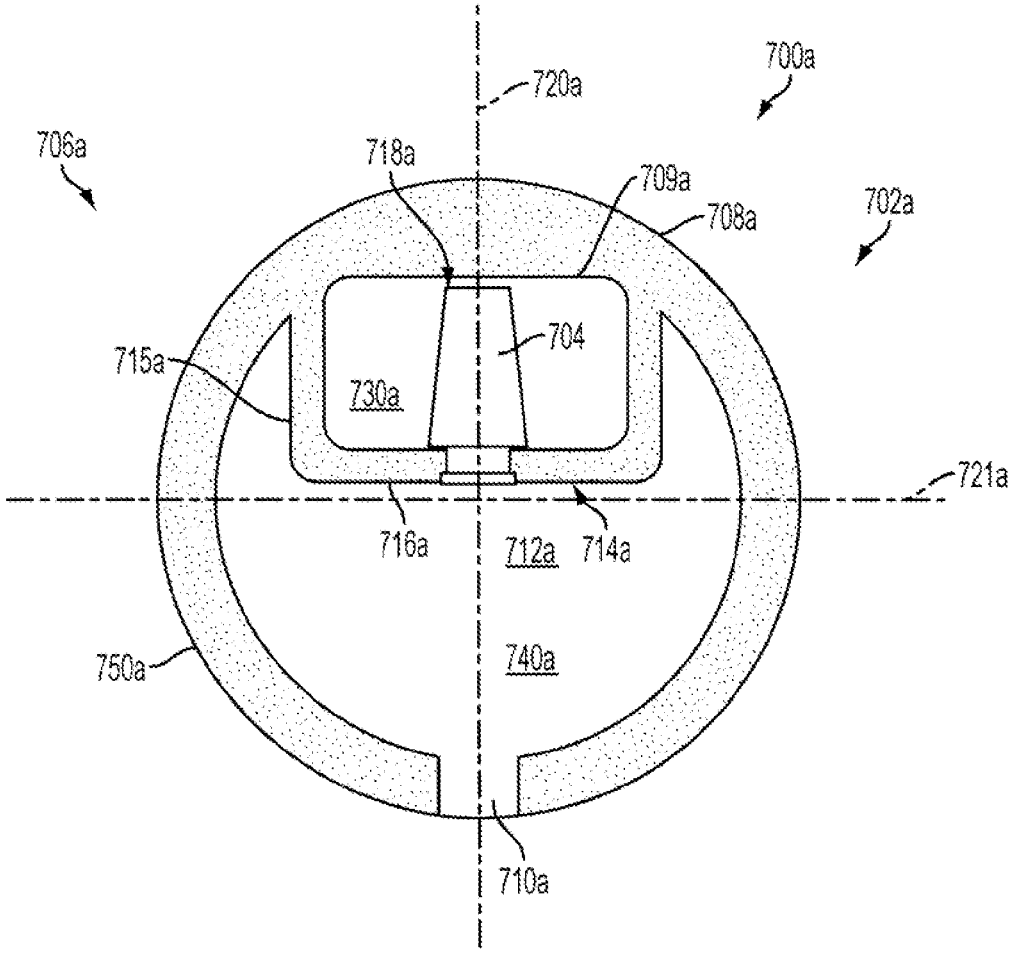
FIGS. 8*a*-8*g* are cross-sectional schematic view of respective noise producing toy structures in accordance with one or more embodiments of the present invention.

In accordance with one or more embodiments of the present invention, FIG. 8*a* is a cross-sectional schematic view of a noise producing toy structure. A noise producing toy structure 700*a* includes a toy 702*a* and squeaker 704. The toy comprises a substantially hollow body 706*a* having any suitable shape that includes the present noise producing toy structure.

An outer wall 708*a* of the body comprises a thick-wall construction and defines an inner space 712*a*. The outer wall includes at least one opening 710*a* for passage of the fluid. The opening may comprise a thickened peripheral portion for reinforcement and may have any suitable dimension. However, the size of the opening is preferably limited so that fluid movement is slowed to prolong the noise production of the squeaker.

An inner wall structure 714*a* comprises a thin-wall construction, i.e., is thinner than the outer wall, and divides the inner space into a sealed cavity 730*a* and a dampening chamber 740*a*, wherein the dampening chamber is much larger than the sealed cavity for limiting the sound level, i.e., volume, of noise. An outer wall portion 709*a* of the toy comprises a thickened wall and spans from one side wall to the other side wall.

The inner wall structure is limited in size to resist unintended removal by placing it in a portion distal from the opening. The inner wall structure includes one or more side walls 715*a* and a transverse wall 716*a* forming a cavity that has a depth approximately the same as the squeaker. A gap 718*a* is provided between the distal end of the squeaker and an outer wall portion 709*a* of the toy, which has been provided with a thickening.

Squeaker 704 is disposed in the transverse wall to project into cavity 730*a* and is connected in any of the manners taught above. The squeaker places cavity 730*a* in fluid communication with chamber 740*a*. Preferably, a longitudinal axis 720*a* of the squeaker 704 connecting the proximal and distal ends of the squeaker also passes substantially through opening 710*a*.

With respect to the inner wall structure, the side walls are preferably angled with respect to a line tangent to the outer wall and protrude into the inner space to form a rectangular shape with the transverse wall in a cross-sectional view. Preferably, the side walls are spaced-apart from the outer wall at the intersection of the transverse wall and the side wall to limit deformation of the cavity 730*a*. Additionally, the inner wall structure is sized to resist deformation of the cavity 730*a* and permit it only when wall portion 709*a* is deformed. Therein, side walls 715*a* are sized to locate the transverse wall and cavity in an upper portion for the body.

Thus, for example, if plane 721*a* denotes a longitudinal plane bisecting the body, the cavity and squeaker are located in the portion distal from the opening to advantageously provide a large dampening chamber 740*a* and/or recess the squeaker from a user accessible portion 750*a* comprising the outer surface of outer wall 708*a*.

Therefore, when the toy is used, a deformation in the outer wall 708*a* except in portion 709*a* will decrease the fluid volume in chamber 740*a*. Some of the fluid will be forced through the fluid passage of the squeaker into cavity 730*a*. In the process, the squeaker produces a noise.

As the body resiliently returns to its original shape, chamber 740*a* expands slowly as the opening 710*a* throttles the quantity of fluid returning into the cavity. As fluid pressure equalizes between cavity 730*a* and chamber 740*a*, fluid moves from cavity 730*a* into chamber 740*a* causing a noise.

Preferably, gap 718*a* may comprise a dimension of 1-5 mm and to further limit the flow of the fluid into and from the cavity 730*a* and prolonging the noise.

In one or more embodiments, opening 710*a* is suitably sized to permit the insertion of treats and when a pet or another animal has manipulated the treats to exit through the opening.

Figure 8B:
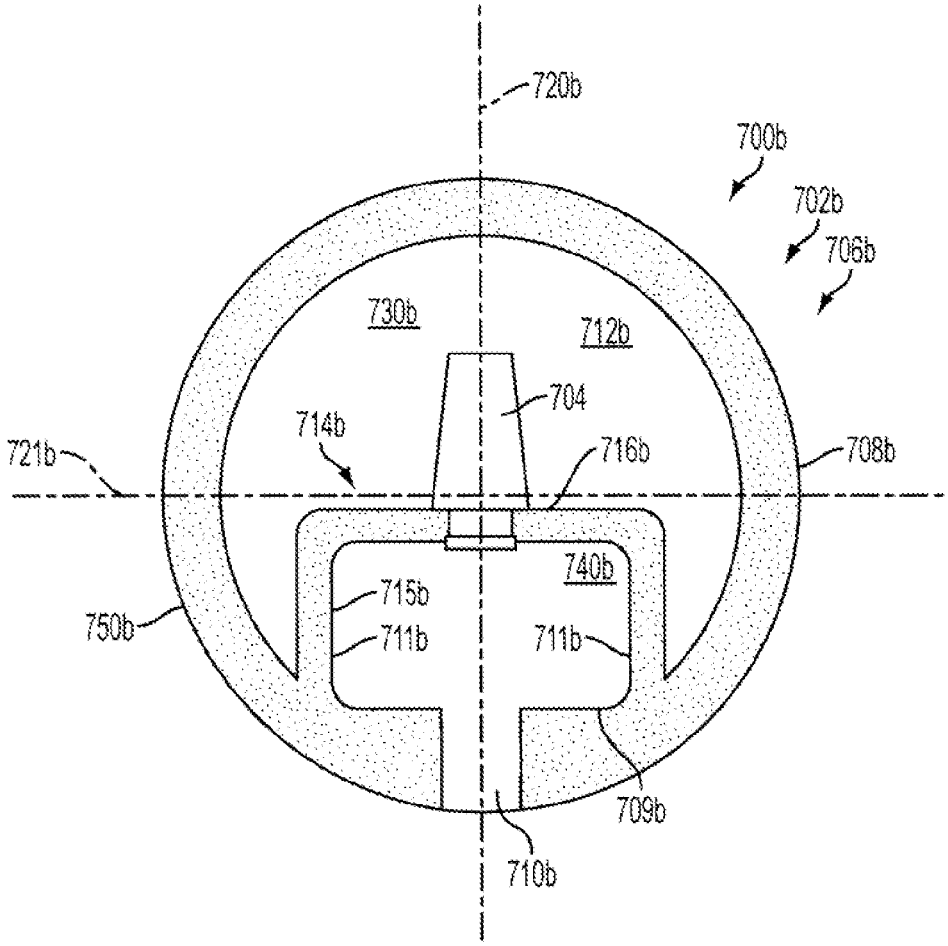

In accordance with one or more embodiments of the present invention, FIG. 8*b* is a cross-sectional schematic view of a noise producing toy structure. A noise producing toy structure 700*b* includes a toy 702*b* and squeaker 704. The toy comprises a substantially hollow body 706*b* having any suitable shape that includes the present noise producing toy structure.

An outer wall 708*b* of the body comprises a thick-wall construction and defines an inner space 712*b*. The outer wall includes at least one opening 710*b* for passage of the fluid. The opening may comprise a thickened peripheral portion for reinforcement and may have any suitable dimension. However, the size of the opening is preferably limited so that fluid movement is slowed to prolong the noise production of the squeaker.

An inner wall structure 714*b* comprises a thin-wall construction, i.e., is thinner than the outer wall, and divides the inner space into a sealed cavity 730*b* and dampening chamber 740*b*, wherein the sealed cavity is larger than the dampening chamber to increase the sound level of the noise. The inner wall structure is disposed in a portion proximal to the opening. The inner wall structure includes one or more side walls 715*b* and a transverse wall 716*b*. An outer wall portion 709*b* of the toy comprises a thickened wall and spans from one side wall to the other side wall.

Squeaker 704 is disposed in the transverse wall to project into cavity 730*b* and is mounted in any of the manners taught above. The squeaker places cavity 730*b* in fluid communication with chamber 740*b*. Preferably, a longitudinal axis 720*b* of the squeaker 704 connecting the proximal and distal ends of the squeaker also passes substantially through opening 710*b*.

With respect to the inner wall structure, the side walls are preferably angled with respect to a line tangent to the outer wall and protrude into the inner space. Preferably, the side walls are spaced apart from the outer wall at the intersection of the transverse wall and the side wall to limit deformation of chamber 740*b*. Preferably, the side walls are sized so that the cavity 730*b* is deformed when the outer wall 708*b* is deformed. Therein, side walls 715*b* are sized to locate the transverse wall and cavity in a lower portion for the body.

Thus, for example, if plane 721*b* denotes a longitudinal plane bisecting the body, the cavity and squeaker are located in the portion proximal to the opening to advantageously provide a large sealed cavity 730*b* to maximize sound volume. Furthermore, to maximize the volume of the sealed cavity, the side walls may be formed to comprise a cylinder and/or other enclosed structure preferably having an inner dimension 711*b* between the side walls and wherein the transverse wall provides a closed end.

To recess the squeaker from a user accessible portion 750*b* comprising the outer surface of outer wall 708*b* and to resist unintended removal of the squeaker from the toy, the flange of the squeaker may be located close to the bisecting plane 721*b* to minimize access to the squeaker.

When the toy is used, a deformation in the outer wall 708*b* except in portion 709*b* will decrease the fluid volume in cavity 730*b*. The fluid will be forced through the fluid passage of the squeaker into chamber 740*b*. In the process, the squeaker produces a noise.

As the body resiliently returns to its original shape, cavity 730*b* expands slowly as the opening 710*b* throttles the quantity of fluid returning into the cavity. The fluid movement through the squeaker causes a prolonged noise as fluid pressure equalizes between cavity 730*b* and chamber 740*b*.

In one or more embodiments, opening 710*b* is suitably sized to permit the insertion of treats and when a pet or another animal has manipulated the treats to exit through the opening.

Figure 8C:
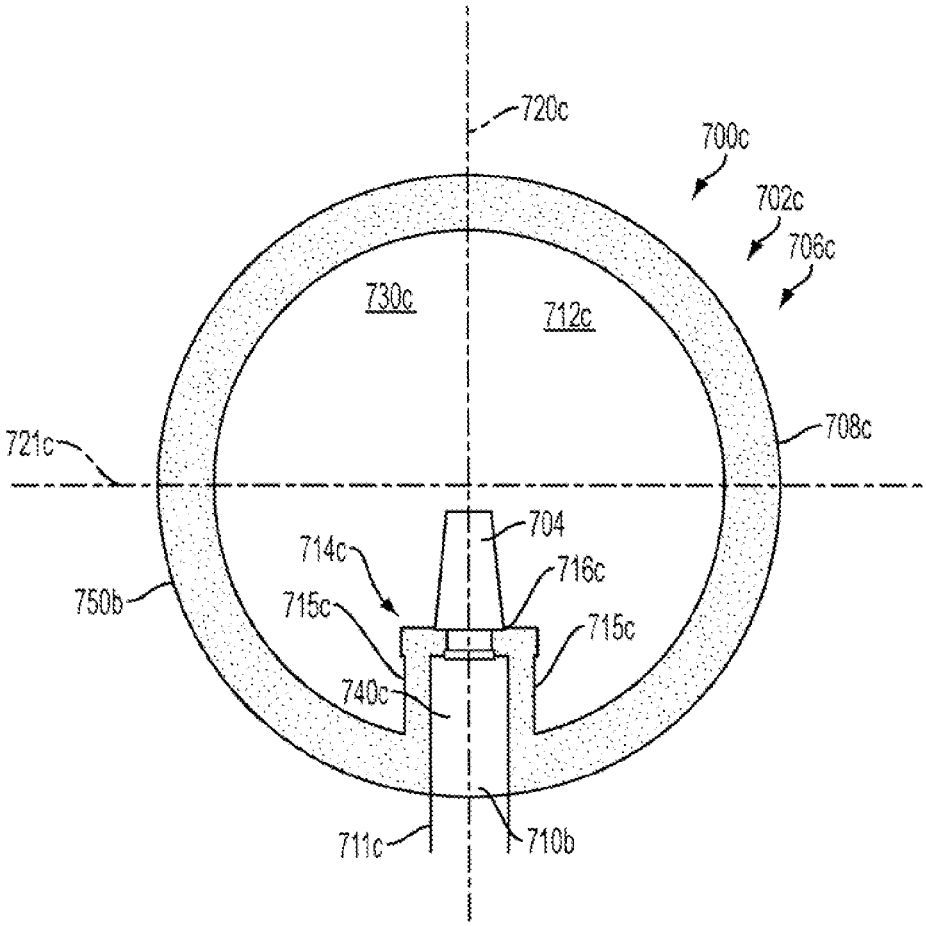

In accordance with one or more embodiments of the present invention, FIG. 8*c* is a cross-sectional schematic view of a noise producing toy structure. A noise producing toy structure 700*c* includes a toy 702*c* and squeaker 704. The toy comprises a substantially hollow body 706*c* having any suitable shape that includes the present noise producing toy structure.

An outer wall 708*c* of the body comprises a thick-wall construction and defines an inner space 712*c*. The outer wall includes at least one opening 710*c* for passage of the fluid, as further described below. The opening may comprise a thickened peripheral portion for reinforcement and may have any suitable dimension. However, the size of the opening is preferably limited so that fluid movement is slowed to prolong the noise production of the squeaker.

An inner wall structure 714*c* comprises a thin-wall construction, i.e., is thinner than the outer wall, and divides the inner space into a sealed cavity 730*c* and dampening chamber 740*c*, wherein the sealed cavity is substantially larger than the dampening chamber to increase the sound level of the noise. The inner wall structure may comprise a pair of spaced-apart side walls 715*c*, which substantially define opening 710*c* in the outer wall for passage of ambient fluid. The inner wall structure further comprises a transverse wall 716*c* that connects the side walls.

Squeaker 704 is disposed in the transverse wall and projects into cavity 730*c*. The squeaker may be mounted in the transverse wall in any of the manners taught above. The squeaker places cavity 730*c* in fluid communication with chamber 740*c*. Preferably, a longitudinal axis 720*c* of the squeaker 704 connecting the proximal and distal ends of the squeaker also passes substantially through opening 710*c*.

With respect to the inner wall structure, the side walls are preferably angled with respect to a tangent line of the outer wall in a cross-sectional view. The side walls protrude into the inner space and may form a rectangular shape with the transverse wall in a cross-sectional view. Advantageously, side walls 715*c* are preferably sized to locate the transverse wall and cavity in a lower portion for the body.

Thus, for example, if plane 721*c* denotes a longitudinal plane bisecting the body, the cavity and squeaker are located in the portion proximal to the opening to advantageously provide a large sealed cavity 730*c* to maximize sound volume. Furthermore, to maximize the volume of the sealed cavity, the side walls may be formed to comprise a cylinder and/or other enclosed structure preferably having an inner dimension 711*c* substantially identical to the opening 710*c* and wherein the transverse wall provides a closed end.

To recess the squeaker from a user accessible portion 750*c* comprising the outer surface of outer wall 708*b* and to resist unintended removal of the squeaker from the toy, the flange of the squeaker may be located close to the bisecting plane 721*c* to minimize access to the squeaker.

When the toy is used, a deformation in the outer wall 708*c* except at the opening 710*c* will decrease the fluid volume in cavity 730*c*. The fluid will be forced through the fluid passage of the squeaker into chamber 740*c*. In the process, the squeaker produces a noise.

As the body resiliently returns to its original shape, cavity 730*c* expands as fluid returns to the cavity. The fluid movement through the squeaker causes a prolonged noise as fluid pressure equalizes between cavity 730*c* and chamber 740*c*.

Figure 8D:
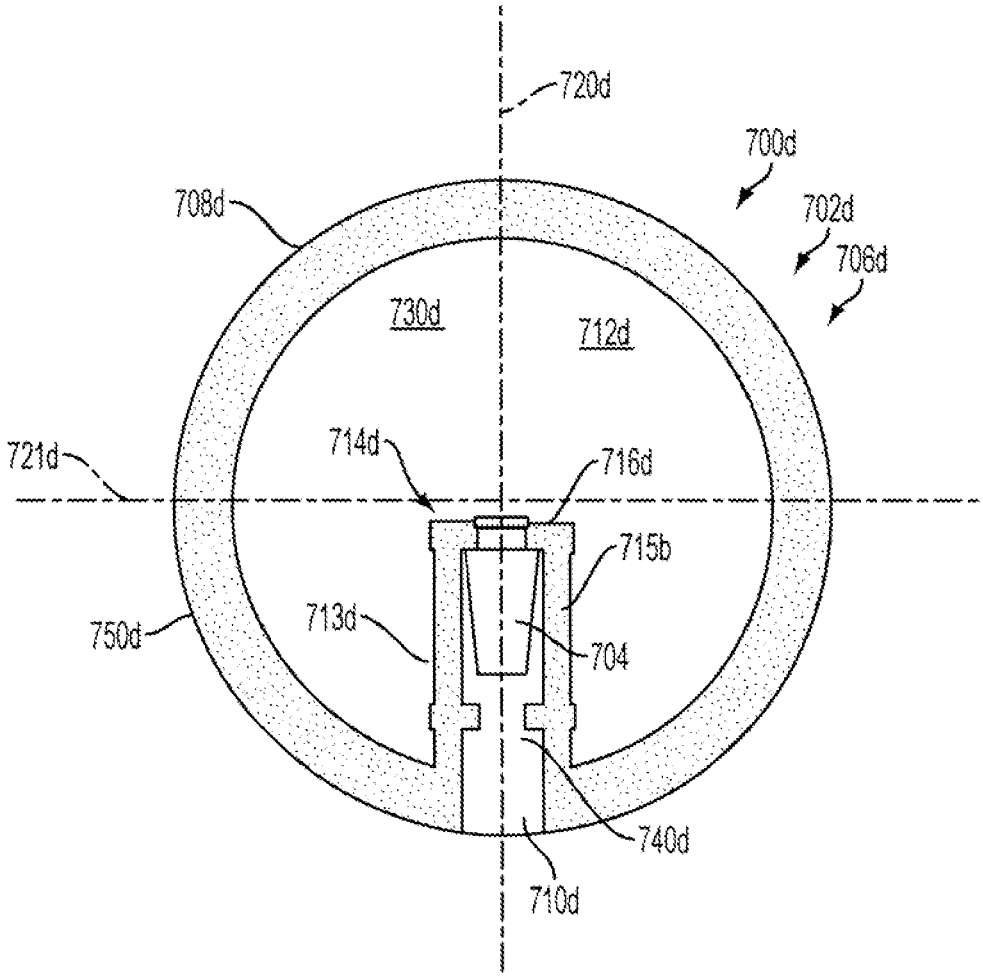

In accordance with one or more embodiments of the present invention, FIG. 8*d* is a cross-sectional schematic view of a noise producing toy structure. A noise producing toy structure 700*d*, which may be similar to noise producing toy structure 700*d*, includes a toy 702*d* and squeaker 704. The toy comprises a substantially hollow body 706*d* having any suitable shape that includes the present noise producing toy structure.

An outer wall 708*d* of the body comprises a thick-wall construction and defines an inner space 712*d*. The outer wall includes at least one opening 710*d* for passage of the fluid, as further described below. The opening may comprise a thickened peripheral portion for reinforcement and may have any suitable dimension. However, the size of the opening is preferably limited so that fluid movement is slowed to prolong the noise production of the squeaker.

An inner wall structure 714*d* comprises a thin-wall construction, i.e., is thinner than the outer wall, and divides the inner space into a sealed cavity 730*d* and dampening chamber 740*d*, wherein the sealed cavity is substantially larger than the dampening chamber to increase the sound level of the noise. The inner wall structure may comprise a pair of spaced-apart side walls 715*d*, which substantially define opening 710*d* in the outer wall for passage of ambient fluid. The inner wall structure further comprises a transverse wall 716*d* that connects the side walls.

Squeaker 704 is disposed in the transverse wall and projects into chamber 740*d* to maximize the volume of cavity 730*d*. The squeaker may be mounted in the transverse wall in any of the manners taught above. The squeaker places cavity 730*d* in fluid communication with chamber 740*d*. Preferably, a longitudinal axis 720*d* of the squeaker 704 connecting the proximal and distal ends of the squeaker also passes substantially through opening 710*d*.

With respect to the inner wall structure, the side walls are preferably angled with respect to a tangent line of the outer wall in a cross-sectional view. The side walls protrude into the inner space and may form a rectangular shape with the transverse wall in a cross-sectional view. Advantageously, side walls 715*d* are preferably sized to locate the transverse wall and cavity in a lower portion for the body.

Thus, for example, if plane 721*d* denotes a longitudinal plane bisecting the body, the cavity and squeaker are located in the portion proximal to the opening to advantageously provide a large sealed cavity 730*d* to maximize sound volume. Furthermore, to maximize the volume of the sealed cavity, the side walls may be formed to comprise a cylinder and/or other enclosed structure preferably having an inner dimension 711*d* substantially identical to the opening 710*d* and wherein the transverse wall provides a closed end.

To recess the squeaker from a user accessible portion 750*d* comprising the outer surface of outer wall 708*d* and to resist unintended removal of the squeaker from the toy, the flange of the squeaker may be located close to the bisecting plane 721*d* to minimize access to the squeaker. Additionally, Stub walls 713*d* that project into chamber 740*d* may be provided and further resist unintended access to the squeaker.

When the toy is used, a deformation in the outer wall 708*d* except at the opening 710*d* will decrease the fluid volume in cavity 730*d*. The fluid will be forced through the fluid passage of the squeaker into chamber 740*d*. In the process, the squeaker produces a noise.

As the body resiliently returns to its original shape, cavity 730*d* expands as fluid returns to the cavity. The fluid movement through the squeaker causes a prolonged noise as fluid pressure equalizes between cavity 730*d* and chamber 740*d*.

Figure 8E:
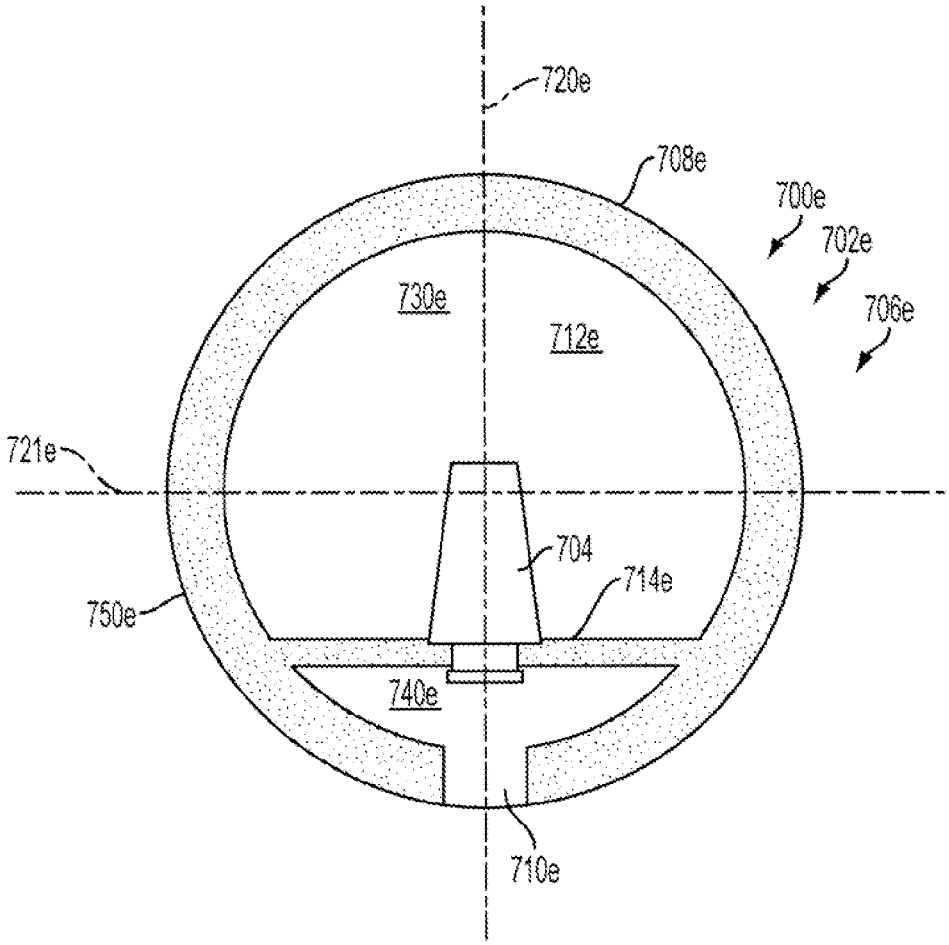

In accordance with one or more embodiments of the present invention, FIG. 8*e* is a cross-sectional schematic view of a noise producing toy structure. A noise producing toy structure 700*e* includes a toy 702*e* and squeaker 704. The toy comprises a substantially hollow body 706*e* having any suitable shape that includes the present noise producing toy structure.

An outer wall 708*e* of the body comprises a thick-wall construction and defines an inner space 712*e*. The outer wall includes at least one opening 710*e* for passage of the fluid. The opening may comprise a thickened peripheral portion for reinforcement and may have any suitable dimension. However, the size of the opening is preferably limited so that fluid movement is slowed to prolong the noise production of the squeaker.

An inner wall structure 714*e* comprises a thin-wall construction, i.e., is thinner than the outer wall, and preferably is formed as a planar inner wall, which comprises a first end and a second end that are joined to an inner surface of the outer wall. The inner wall structure divides the inner space into a sealed cavity 730*e* and dampening chamber 740*e*, wherein the sealed cavity is substantially larger than the dampening chamber to increase the sound level of the noise.

Squeaker 704 is disposed in the inner wall and projects into cavity 730*e*. The squeaker may be mounted in any of the manners taught above. The squeaker places cavity 730*e* in fluid communication with chamber 740*e*. Preferably, a longitudinal axis 720*e* of the squeaker 704 connecting the proximal and distal ends of the squeaker also passes substantially through opening 710*e*.

Advantageously, the inner wall is located in a lower portion for the body. Thus, for example, if plane 721*e* denotes a longitudinal plane bisecting the body, the cavity and squeaker are located in the portion proximal to the opening to advantageously provide a large sealed cavity 730*e* to maximize sound volume yet recessed to hinder access to the squeaker.

The squeaker is recessed from a user accessible portion 750*e* comprising the outer surface of outer wall 708*e* by spacing the inner wall a sufficient distance from opening 710*e*. In accordance with one embodiment of the present invention, the flange of the squeaker may be located close to the bisecting plane 721*e* to minimize access to the squeaker.

When the toy is used, a deformation in the outer wall 708*e* proximal to cavity 730*e* will decrease the fluid volume in the cavity. The fluid will be forced through the fluid passage of the squeaker into chamber 740*e*. In the process, the squeaker produces a noise.

As the body resiliently returns to its original shape, cavity 730*e* expands as fluid returns to the cavity. The fluid movement through the squeaker causes a noise as fluid pressure equalizes between cavity 730*e* and chamber 740*e*.

Figure 8F:
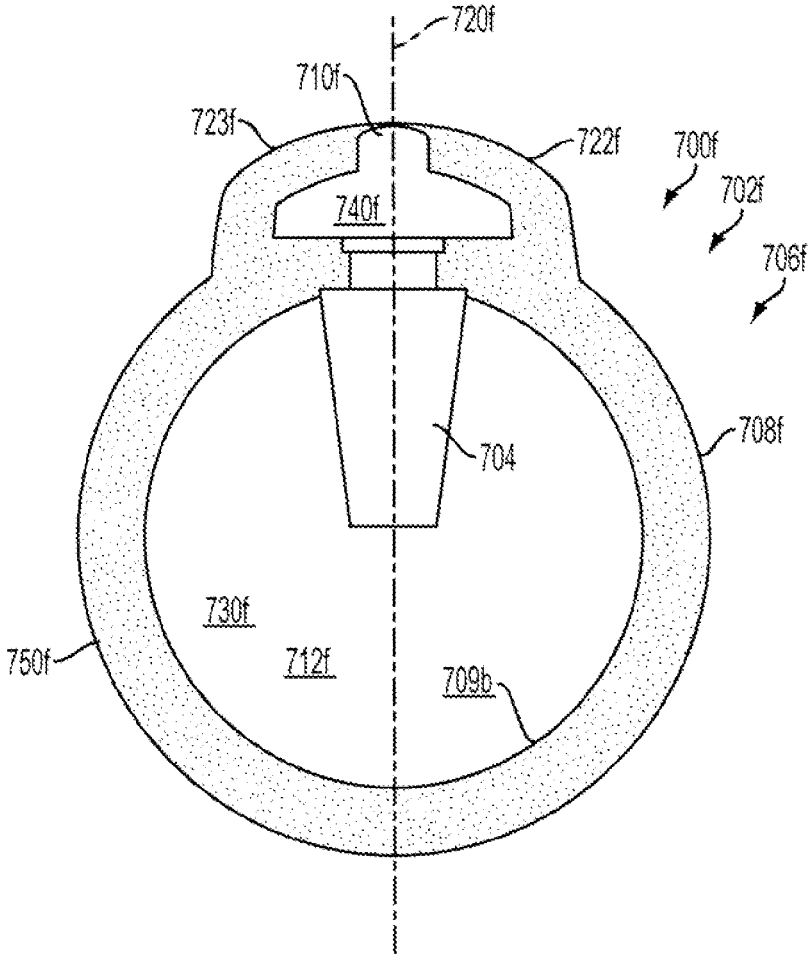

In accordance with one or more embodiments of the present invention, FIG. 8*f* is a cross-sectional schematic view of a noise producing toy structure. A noise producing toy structure 700*f* includes a toy 702*f* and squeaker 704. The toy comprises a substantially hollow body 706*f* having any suitable shape that includes the present noise producing toy structure.

An outer wall 708*f* of the body comprises a thick-wall construction and defines an inner space 712*f* which is substantially identical to a cavity 730*f*. Squeaker 704 is disposed in the outer wall in any manner taught above.

A crown 722*f* is provided proximal to the squeaker for recessing the squeaker from a user accessible portion 750*f*, which comprises the outer surface of outer wall 708*f* and the outer surface of the crown. The crown comprises one or more walls 723*f* having a thick-wall construction that form a chamber 740*f*.

An opening 710*f* is provided in walls 723*f* to permit passage of ambient fluid into the chamber. The chamber is in fluid communication with cavity 730*f* via the squeaker. The opening may be reinforced at a peripheral portion and may be sized to limit the volume of fluid that is able to move through the opening to prolong the sound of the squeaker. Preferably, a longitudinal axis 720*f* of the squeaker 704 connecting the proximal and distal ends of the squeaker also passes substantially through opening 710*f*. However, it should be appreciated that the opening may be offset and that indeed the crown may be off-set.

When the toy is used, a deformation in the outer wall 708*f* will decrease the fluid volume in cavity 730*f*. The fluid will be forced through the fluid passage of the squeaker into chamber 740*f*. In the process, the squeaker produces a noise.

As the body resiliently returns to its original shape, cavity 730*f* expands slowly as the opening 710*f* throttles the quantity of fluid returning into the cavity. The fluid movement through the squeaker causes a prolonged noise as fluid pressure equalizes between cavity 730*f* and chamber 740*f*.

In one or more embodiments, opening 710*f* is suitably sized to permit the insertion of treats into chamber 740*f* and when a pet or another animal has manipulated the treats to exit through the opening.

Figure 8G:
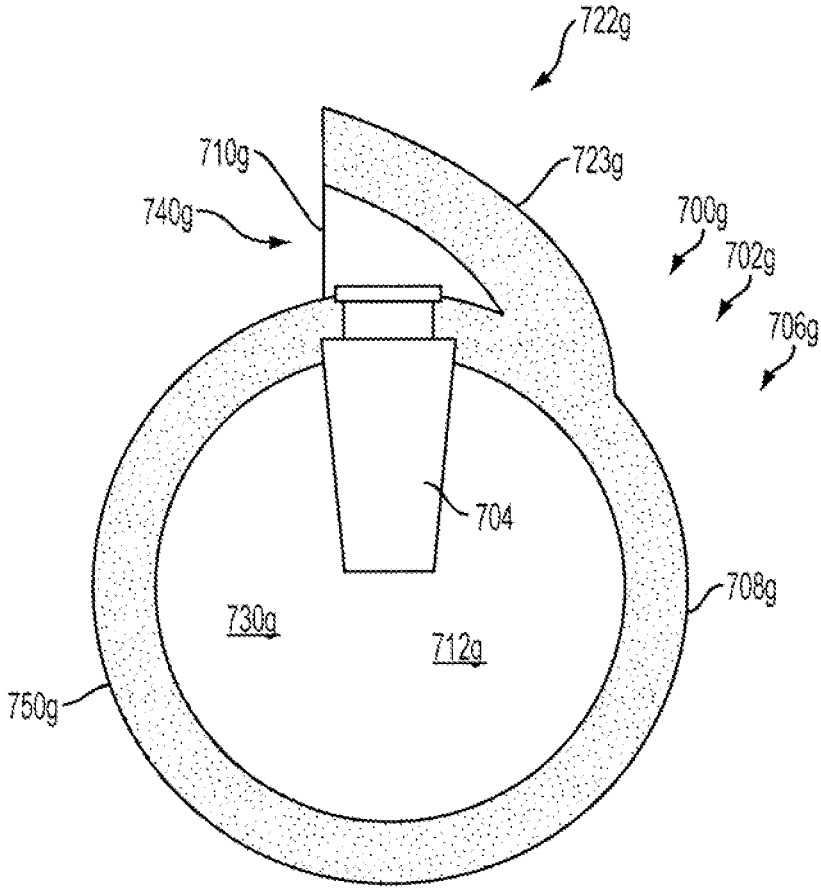

In accordance with one or more embodiments of the present invention, FIG. 8*g* is a cross-sectional schematic view of a noise producing toy structure. A noise producing toy structure 700*g* includes a toy 702*g* and squeaker 704. The toy comprises a substantially hollow body 706*g* having any suitable shape that includes the present noise producing toy structure.

An outer wall 708*g* of the body comprises a thick-wall construction and defines an inner space 712*g* which is substantially identical to a cavity 730*g*. Squeaker 704 is disposed in the outer wall in any manner taught above.

A crown 722*g* is provided proximal to the squeaker for recessing the squeaker from a user accessible portion 750*g*, which comprises the outer surface of outer wall 708*g* and the outer surface of the crown. The crown comprises one or more angled walls 723*g* having a thick-wall construction that form a chamber 740*g* open to a side away from the angled wall to form an access 710*g* that permits passage of ambient fluid into the chamber.

The chamber is in fluid communication with cavity 730*g* via the squeaker. Wall 723*g* may be reinforced at a peripheral portion of access 710*g*. Access 710*g* may be sized to limit the volume of fluid that is able to move through the opening to prolong the sound of the squeaker.

When the toy is used, a deformation in the outer wall 708*g* will decrease the fluid volume in cavity 730*g*. The fluid will be forced through the fluid passage of the squeaker into chamber 740*g*. In the process, the squeaker produces a noise.

As the body resiliently returns to its original shape, cavity 730*g* expand as fluid returns into the cavity. The fluid may be slowed by a limitation in the size of access 710*g* that throttles the quantity of fluid returning into the cavity. The fluid movement through the squeaker causes a prolonged noise as fluid pressure equalizes between cavity 730*g* and chamber 740*g*.

In one or more embodiments, opening 710*g* is suitably sized to permit the insertion of treats into chamber 740*g* and when a pet or another animal has manipulated the treats to exit through the opening.

Figure 8H:
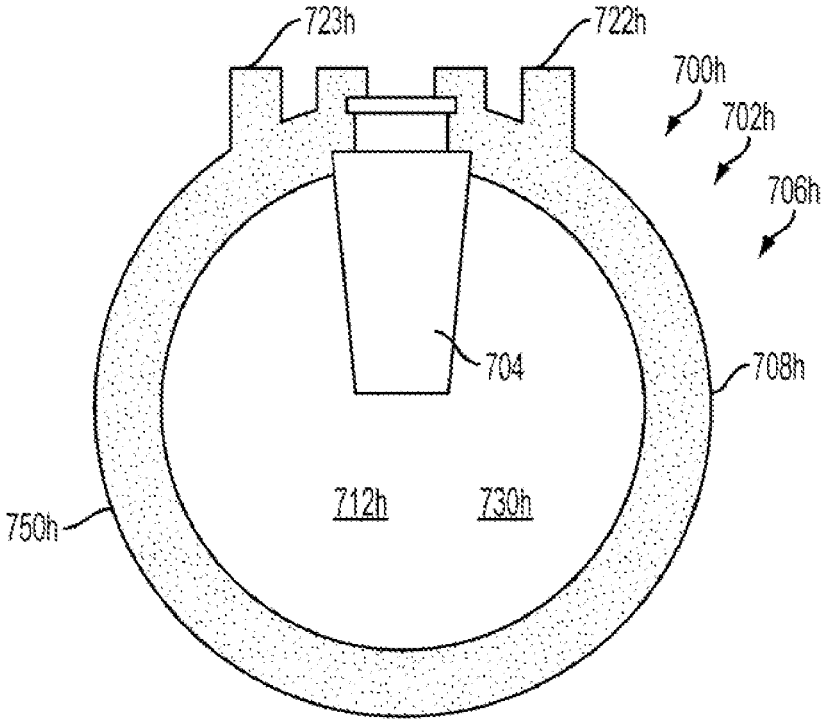
FIGS. 8*h* and 8*i* are cross-sectional schematic views of respective noise producing toy structures in accordance with one or more embodiments of the present invention.
Figure 8I:
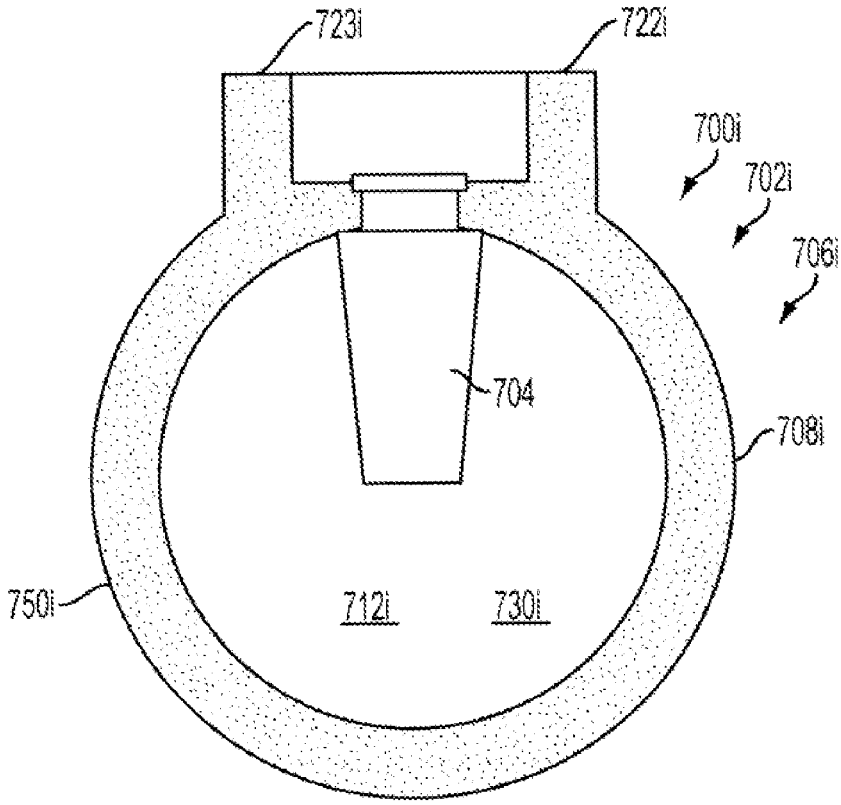

FIGS. 8*h* and 8*i* are cross-sectional schematic views of respective noise producing toy structures in accordance with one or more embodiments of the present invention. Although the figures illustrate a body having a substantially circular outer wall in cross-section, the present invention is not limited to a toy or toy structure that is circular in cross-section. The cross-sectional shapes herein are illustrative only, and, thus, square, octagonal, irregular, rectangular, and/or any other shape that may be suitable are contemplated for use.

The body comprises natural rubber and/or like elastic and/or resilient material and preferably when thrown provides a bounce to enhance the use of the toy or when used is resiliently elastic to permit the partial or complete evacuation of fluid media from one or more cavities or spaces. As used herein "used" refers to the toy being thrown, squeezed, impacted, manipulated or otherwise temporarily deformed sufficient to permit the partial or complete evacuation of fluid media, such as air, from one or more cavities or spaces.

The cavities described herein need not extend along the entire length of the body but may be formed with end walls and thus comprise structures upright from another wall.

A noise producing toy structure 700*h*-700*i* for a toy for a pet or human comprises a respective toy 702*h*-702*i* and a noise producing assembly or noise producing element 704, hereinafter referred to as a squeaker 704 for simplicity. Squeaker 704 may be any of the squeakers taught previously and especially noise producing assembly 600 having a shroud 602 that completely encases a squeaker mechanism, and which is mounted in the toy.

Respective toy 702*h*-702*i* includes a respective body 706*h*-706*i* comprising one or more walls upright from the outer wall and that are disposed proximal to a noise producing element. A free end of the wall or walls spaces a user from the squeaker and hinders access to the squeaker.

In accordance with one or more embodiments of the present invention, FIG. 8*h* is a cross-sectional schematic view of a noise producing toy structure. A noise producing toy structure 700*h* includes a toy 702*h* and squeaker 704. The toy comprises a substantially hollow body 706*h* having any suitable shape that includes the present noise producing toy structure.

An outer wall 708*h* of the body comprises a thick-wall construction and defines an inner space 712*h* which is substantially identical to a sealed cavity 730*h*. Squeaker 704 is disposed in the outer wall in any manner taught above.

A crown 722*h* is provided proximal to the squeaker for recessing the squeaker from a user accessible portion 750*h*, which comprises at least the outer surface of outer wall 708*h*. The crown comprises one or more spaced-apart walls 723*h* having a thick-wall construction. A space 740*h* between the walls permits passage of ambient fluid into the cavity via the squeaker.

Walls 723*h* may be suitable spaced to prevent an animal from gaining access to the squeaker.

When the toy is used, a deformation in the outer wall 708*h* will decrease the fluid volume in cavity 730*h*. The fluid will be forced through the fluid passage of the squeaker into the environment. In the process, the squeaker produces a noise.

As the body resiliently returns to its original shape, cavity 730*h* expand as fluid returns into the cavity. The fluid movement through the squeaker causes noise as fluid pressure equalizes between cavity 730*h* and the environment.

In accordance with one or more embodiments of the present invention, FIG. 8*i* is a cross-sectional schematic view of a noise producing toy structure. A noise producing toy structure 700*i* includes a toy 702*i* and squeaker 704. The toy comprises a substantially hollow body 706*i* having any suitable shape that includes the present noise producing toy structure.

An outer wall 708*i* of the body comprises a thick-wall construction and defines an inner space 712*i* which is substantially identical to a sealed cavity 730*i*. Squeaker 704 is disposed in the outer wall in any manner taught above.

A crown 722*i* is provided proximal to the squeaker for recessing the squeaker from a user accessible portion 750*i*, which comprises at least the outer surface of outer wall 708*i*. The crown comprises a plurality spaced-apart walls 723*i* having a thick-wall construction. A space 740*i* between the walls permits passage of ambient fluid into the cavity via the squeaker.

Walls 723*i* may be suitable spaced and numerous to prevent an animal from gaining access to the squeaker.

When the toy is used, a deformation in the outer wall 708*i* will decrease the fluid volume in cavity 730*i*. The fluid will be forced through the fluid passage of the squeaker into the environment. In the process, the squeaker produces a noise.

As the body resiliently returns to its original shape, cavity 730*i* expand as fluid returns into the cavity. The fluid movement through the squeaker causes noise as fluid pressure equalizes between cavity 730*i* and the environment.

Figure 9:
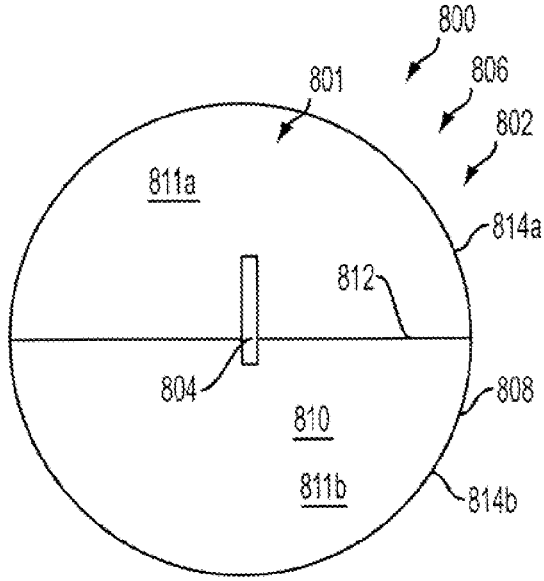
FIG. 9 is a cross-sectional schematic view of a noise producing toy structure in accordance with one or more embodiments of the present invention.

FIG. 9 is a cross-sectional schematic view of a noise producing toy structure in accordance with one or more embodiments of the present invention. Although the figure illustrates a body having a substantially circular outer wall in cross-section, the present invention is not limited to a toy or toy structure that is circular in cross-section. The cross-sectional shape herein is illustrative only, and, thus, square, octagonal, irregular, rectangular, and/or any other shape that may be suitable are contemplated for use.

The body comprises natural rubber, synthetic rubber, thermoplastic elastomers, vinyl, and/or like elastic and/or resilient material and preferably when thrown provides a bounce to enhance the use of the toy or when used is resiliently elastic to permit the partial or complete evacuation of fluid media from one or more cavities or spaces. As used herein "used" refers to the toy being thrown, squeezed, impacted, manipulated or otherwise temporarily deformed sufficient to permit the partial or complete evacuation of fluid media, such as air, from one or more cavities or spaces.

The cavities described herein need not extend along the entire length of the body but may be formed with end walls and thus comprise structures upright from another wall.

As taught herein, the mounting of a squeaker is different in vinyl or in natural rubber or synthetic rubber. Herein, natural or synthetic rubber is preferred as a body for the toy.

A noise producing toy structure 800 includes a toy 802 and a squeaker 804. Squeaker 804 may be any squeaker as taught above. The toy comprises a substantially hollow body 806 having any suitable shape that includes the present noise producing toy structure.

An outer wall 808 of the body comprises a thick-wall construction and defines a sealed inner space 810. The body comprises an inner wall 812 that divides the sealed inner space into a first sealed cavity 811*a* and a second cavity 811*b* each having a predetermined quantity of a fluid medium, such as air, that is generally indicated as 801.

Squeaker 804 is disposed inner wall 812 and may be mounted as taught above. The squeaker places cavities 811*a* and 811*b* in fluid communication.

When used, an outer portion 814*a* of outer wall 808 that is proximal to cavity 811*a* or an outer portion 814*b* of outer wall 808 that is proximal to cavity 811*b* may impact creating pressure in the cavity and causing the fluid to move through the squeaker to the other cavity and creating noise.

Since the squeaker is disposed inside the body, access requires creating an opening in the body and removing the squeaker from the inner wall. Thus, the noise producing toy structure 800 is extremely secure in preventing unintended access to the squeaker.

In accordance with one or more embodiments of the present invention, inner wall 812 comprises one or more openings and, thus, cavities 811*a* and 811*b* are not sealed and are in constant fluid communication.

Therein, when used, an outer portion 814*a* of outer wall 808 that is proximal to cavity 811*a* or an outer portion 814*b* of outer wall 808 that is proximal to cavity 811*b* may impact creating pressure in the cavity and causing the fluid to move at least through the squeaker to the other cavity and creating noise.

Figure 10:
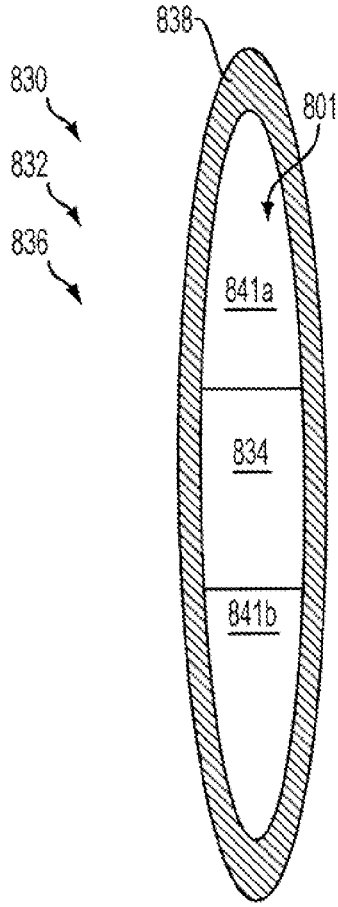
FIG. 10 is a cross-sectional schematic view of a noise producing toy structure in accordance with one or more embodiments of the present invention.

FIG. 10 is a cross-sectional schematic view of a noise producing toy structure in accordance with one or more embodiments of the present invention. Although the figure illustrates a body having a substantially circular outer wall in cross-section, the present invention is not limited to a toy or toy structure that is circular in cross-section. The cross-sectional shape herein is illustrative only, and, thus, square, octagonal, irregular, rectangular, and/or any other shape that may be suitable are contemplated for use.

The body comprises natural rubber, synthetic rubber, thermoplastic elastomers, vinyl, and/or like elastic and/or resilient material and preferably when thrown provides a bounce to enhance the use of the toy or when used is resiliently elastic to permit the partial or complete evacuation of fluid media from one or more cavities or spaces. As used herein "used" refers to the toy being thrown, squeezed, impacted, manipulated or otherwise temporarily deformed sufficient to permit the partial or complete evacuation of fluid media, such as air, from one or more cavities or spaces.

The cavities described herein need not extend along the entire length of the body but may be formed with end walls and thus comprise structures upright from another wall.

As taught herein, the mounting of a squeaker is different in vinyl or in natural rubber or synthetic rubber. Herein, natural or synthetic rubber is preferred as a body for the toy.

A noise producing toy structure 830 includes a toy 832 and a squeaker 834. Squeaker 834 may be any squeaker as taught above. The toy comprises a substantially hollow narrow body 836 having any suitable shape that includes the present noise producing toy structure.

An outer wall 838 of the body comprises a thick-wall construction and defines a sealed inner space 840.

Squeaker 834 is disposed between two opposed portions of outer wall 838 and is mounted between the wall in any suitable manner taught above to divide the sealed inner space into a first sealed cavity 841*a* and a second cavity 841*b* each having a predetermined quantity of a fluid medium, such as air, that is generally indicated as 801. The squeaker places cavities 841*a* and 841*b* in fluid communication.

When used, an outer portion 844*a* of outer wall 838 that is proximal to cavity 841*a* or an outer portion 814*b* of outer wall 838 that is proximal to cavity 841*b* may impact creating pressure in the cavity and causing the fluid to move through the squeaker to the other cavity and creating noise.

Since the squeaker is disposed inside the body, access requires creating an opening in the body and removing the squeaker from the inner wall. Thus, the noise producing toy structure 830 is extremely secure in preventing unintended access to the squeaker.

A system and method has been shown in the above embodiments for the effective implementation of mounting arrangement for squeakers. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

What is claimed is:

1. A noise producing toy structure comprising:

a toy comprising an outer wall, the outer wall defining an inner space;

a sealed cavity and a chamber disposed in the inner space;

an opening in the outer wall for passing ambient fluid into the chamber;

a noise producing element placing the cavity in fluid communication with the chamber;

wherein an inner wall structure is disposed in the inner space for defining the sealed cavity; and wherein a plane bisects the toy into a first portion proximal to the opening and a second portion distal from the opening, the inner wall structure being disposed in the second portion.

2. The noise producing toy structure of claim 1, wherein the opening is disposed at an axis collinear with a longitudinal axis of the noise producing element.

3. The noise producing toy structure of claim 1, wherein the cavity is larger than the chamber.

4. A noise producing toy structure comprising:

a toy comprising an outer wall, the outer wall defining an inner space;

a sealed cavity and a chamber disposed in the inner space;

an opening in the outer wall for passing ambient fluid into the chamber;

a noise producing element placing the cavity in fluid communication with the chamber;

wherein the noise producing element is disposed into the sealed cavity, the cavity having a width slightly larger than a length of a free portion of the noise producing element.

5. The noise producing toy structure of claim 4, wherein the cavity is larger than the chamber.

6. The noise producing toy structure of claim 4, wherein the opening is disposed at an axis collinear with a longitudinal axis of the noise producing element.

7. A noise producing toy structure comprising:

a toy comprising an outer wall, the outer wall defining an inner space;

a sealed cavity and a chamber disposed in the inner space;

an opening in the outer wall for passing ambient fluid into the chamber;

a noise producing element placing the cavity in fluid communication with the chamber;

wherein an inner wall structure is disposed in the inner space for defining the sealed cavity; and wherein the inner wall structure comprises a first and a second spaced-apart side walls, the sidewalls defining the opening.

8. The noise producing toy structure of claim 7, wherein the noise producing element protrudes into the cavity.

9. The noise producing toy structure of claim 7, wherein the noise producing element protrudes into the chamber.

10. The noise producing toy structure of claim 9, wherein a side wall comprises a stub wall disposed between a free end of the noise producing element and the opening, the stub wall hindering access to the noise producing element to resist unintended removal of the noise producing element.

11. The noise producing toy structure of claim 7, wherein the opening is disposed at an axis collinear with a longitudinal axis of the noise producing element.

12. The noise producing toy structure of claim 7, wherein the cavity is larger than the chamber.

13. A noise producing toy structure comprising:

a toy comprising an outer wall, the outer wall defining an inner space;

a sealed cavity and a chamber disposed in the inner space;

an opening in the outer wall for passing ambient fluid into the chamber;

a noise producing element placing the cavity in fluid communication with the chamber;

wherein an inner wall structure is disposed in the inner space for defining the sealed cavity; and wherein the inner wall structure comprises a planar wall.

14. The noise producing toy structure of claim 13, wherein the opening is disposed at an axis collinear with a longitudinal axis of the noise producing element.

15. The noise producing toy structure of claim 13, wherein the cavity is larger than the chamber.

* * * * *